US009706283B2

(12) United States Patent
Stoch

(10) Patent No.: US 9,706,283 B2
(45) Date of Patent: Jul. 11, 2017

(54) NECKLACE AND EARPHONE COMBINATION DEVICE

(71) Applicant: Adrian Stoch, New York, NY (US)

(72) Inventor: Adrian Stoch, New York, NY (US)

( * ) Notice: Subject to any disclaimer, the term of this patent is extended or adjusted under 35 U.S.C. 154(b) by 0 days.

(21) Appl. No.: 15/004,017

(22) Filed: Jan. 22, 2016

(65) Prior Publication Data

US 2016/0373849 A1 Dec. 22, 2016

Related U.S. Application Data

(60) Provisional application No. 62/182,143, filed on Jun. 19, 2015.

(51) Int. Cl.

| | |
|---|---|
| ***H04R 1/10*** | (2006.01) |
| ***A44C 15/00*** | (2006.01) |
| *H04R 1/02* | (2006.01) |

(52) U.S. Cl.

CPC ..... *H04R 1/1016* (2013.01); *A44C 15/005* (2013.01); *H04R 1/105* (2013.01); *H04R 1/028* (2013.01); *H04R 1/1033* (2013.01); *H04R 1/1041* (2013.01); *H04R 2420/07* (2013.01)

(58) Field of Classification Search

CPC ..... H04R 1/10; H04R 1/105; H04R 1/1016; H04R 1/1033; H04R 1/1066; H04R 5/033; H04R 5/0335

See application file for complete search history.

(56) References Cited

U.S. PATENT DOCUMENTS

| | | | | |
|---|---|---|---|---|
| 2008/0037817 | A1* | 2/2008 | Ewert | H04R 1/1033 381/380 |
| 2012/0027242 | A1* | 2/2012 | Son | H04R 1/1058 381/380 |
| 2014/0294192 | A1* | 10/2014 | Haynes | H04R 1/1041 381/74 |
| 2015/0195639 | A1* | 7/2015 | Azmi | H04R 1/1058 381/74 |

FOREIGN PATENT DOCUMENTS

| | | | | |
|---|---|---|---|---|
| KR | 2015063328 A | * | 5/2015 | H04R 1/10 |

* cited by examiner

*Primary Examiner* — Matthew Eason

(74) *Attorney, Agent, or Firm* — Michael J. Feigin, Esq.; Feigin & Fridman LLC

(57) ABSTRACT

A combination necklace and earphone set is disclosed which is changeable between the two configurations by magnetically attaching ear buds at each end of a chain to each other. When attached, the chain is closed, forming a loop and necklace, such that controls for the earphones act as beads on each side and a pendant is situated opposite the ear buds. The pendant, in embodiments, houses a battery which powers the earphones. When detached, the chain is an open loop, with an earphone at each end. A joint between the earphones and wire/chain allows the earphones to swivel with respect to the wire/chain.

18 Claims, 6 Drawing Sheets

NECKLACE AND EARPHONE COMBINATION DEVICE

FIELD OF THE DISCLOSED TECHNOLOGY

The disclosed technology relates generally to an item of Jewelry and, more specifically, to earphones as jewelry.

BACKGROUND OF THE DISCLOSED TECHNOLOGY

Headphones are not often confused with jewelry. They tend to look like electronics because they are, in fact, electronics. They are typically produced out of plastic, and style takes a back seat to function. This is fine for settings where one can wear headphones, but when you're not using them, you typically don't want to walk into a business meeting or restaurant with earphones dangling around your neck; so you have to take them off, fold them up, and put them away. On the other hand, it's socially acceptable to wear a necklace at a business meeting or in a restaurant.

What if there were a method to combine the two so that a necklace could double up as earphones? Samsung has such a product, called the "Gear Circle," which is a set of earphones that can be attached in a loop and worn like a necklace. However, there is room for improvement, as will be discussed in the "Summary of the Disclosed Technology" below.

SUMMARY OF THE DISCLOSED TECHNOLOGY

A combination necklace and earphones set in embodiments of the disclosed technology has the following features. There is a first and second earphone, each having a first end with a ball joint pivot (defined as a solid and generally circular or elliptical ball element, with a second element that is rotatable with respect to the ball), and a second end, generally opposite the first end, with a magnetic field passing there-through. The magnetic field of the second end, produced by a permanent magnet, in embodiments of the disclosed technology is strong enough, such that the second ends of each of the first and said second earphones are in a magnetically held together condition when brought near each other.

The earphones of embodiments of the disclosed technology can also have a first length of wire electrically connecting the first earphone to a first control housing which has controls for changing the output of one or both earbuds. A second length of wire can electrically connect the second earphone to a second set of controls within a second control housing. The first control housing is identically sized with the second control housing in embodiments, and the first length and the second length of wire can be of identical length. As such, the first earphone is then symmetric in size and position, with the second earphone (such as/defined as a) about an invisible vertical plane situated halfway between them and/or b) from end to end of the earphones with wires and other devices situated electrically there-between). Further, the first wire can be symmetric in size and position with the second wire, and the battery housing can be symmetric in size and position with the control housing.

A pendant can be situated equidistant between the control housings and simultaneously be a battery housing housing a battery. The pendant can have an identical or matching but reversed color scheme, with identical stripes and background (or inverted stripes and background) as each of the first and second earphones. When the first and second earphones are in a magnetically held together condition, forming a closed loop, the pendant, in embodiments, is situated opposite the earphones. The first and second earphones rotate with respect to the pendant, in embodiments of the disclosed technology, via a ball joint pivot, such that in the magnetically held together condition, the second end of the first and second earphones are in parallel with the pendant when the earphones are worn, as well as when the earphones are in the magnetically held together condition. However, an angle between the first wire and the first earphone, as well as between the second wire and second earphone, is more acute when the earphones are worn (in the open loop configuration) than when the first and second earphones are in a magnetically held together condition (in the closed loop configuration).

Each second end of the first and second earphones has, in embodiments of the disclosed technology, an outer region with portals opening to a speaker, and an inner region covering a magnet used to create the magnetically held together condition.

A method of wearing a combination necklace and earphone device, such as the one described above, is carried out as follows. These steps can be carried out in any order, such as the order written or the opposite order. One step involves donning each of a first and a second earphones such that a first control housing hangs downward from the first earphone, and a second control housing hangs downward from the second earphone, each such battery housing and control housing having the same height and circumference as the other, and being equidistant from the ground. In another step, one connects second ends of the first and the second earphones to each other via magnetic force forming a loop. The loop has, in order, the first and second earphone (together), one of the control housings with controls, a pendant, a second control housing with further controls, such that, in embodiments, the earphones are at opposite sides of the loop from the pendant. One can wear the earphones as part of a necklace after the step of "connecting." An additional step of disconnecting the second ends of the first and second earphones from each other can be carried out. This can be before the step of "donning," (as recited above) and the steps can be repeated cyclically.

The earphones themselves can have a first end, a second end opposite the first, and a ball joint pivot connecting the earphones to respective control housings by way of a wire. The first earphone and the second earphone rotate with respect to the pendant (and battery therein, in embodiments) via the ball joint pivot, in embodiments of the disclosed technology. This happens such that, in the magnetically held together condition, the second end of the first and second earphones are in parallel with the pendant when the earphones are worn, as well as when the earphones are in the magnetically held together condition. However, the angle between the battery housing and first earphone (as well as the corresponding parts to the other ball joint) can be more acute after the step of donning than after the step of connecting. This happens because of the smaller loop when it is connected, as opposed to a space between the sides making for an open configuration or "loop" when not connected.

The pendant can have an identical color scheme with identical stripes as each of the first and second earphones. Or, the pendant can have a stripe matching the majority/background color of each of the first and second earphones, while a stripe on the first and second earphones matches that of the majority/background color of the pendant.

In some embodiments, each second end of the first and the second earphones has an outer region with portals opening to a speaker, and an inner region covering a magnet used to create the magnetically held together condition.

"Substantially" and "generally," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

A combination necklace and earphone set is disclosed which is changeable between the two configurations by magnetically attaching ear buds (defined as in-ear speakers) at each end of a chain to each other. When attached, the chain is closed, forming a loop and necklace, such that controls for the earphones act as beads on each side and a pendant is situated opposite the ear buds. When detached, the chain is an open loop, with an earphone at each end. A joint between the earphones and wire/chain allows the earphones to swivel with respect to the wire/chain.

Embodiments of the disclosed technology will become clearer in view of the following description of the drawings.

Figure 1A:
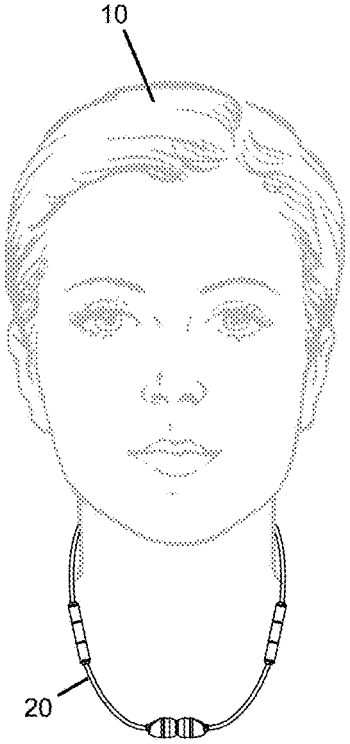
FIG. 1A shows a closed loop necklace worn in an embodiment of the disclosed technology.

FIG. 1A shows a closed loop necklace worn in an embodiment of the disclosed technology. Here, the necklace 20 is attached with various beads and pendants, as shown.

Figure 1B:
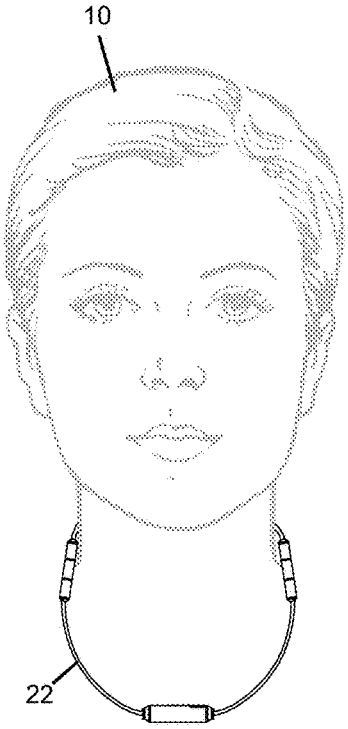
FIG. 1B shows the necklace of FIG. 1A rotating 180 degrees.

FIG. 1B shows the necklace of FIG. 1A rotating 180 degrees. By rotating the necklace 20 of FIG. 1A, the ear buds which were in the front are hidden from view. Instead, a similar-sized (defined as within a 20% tolerance level in any direction) pendant is shown in front in necklace 22.

Figure 1C:
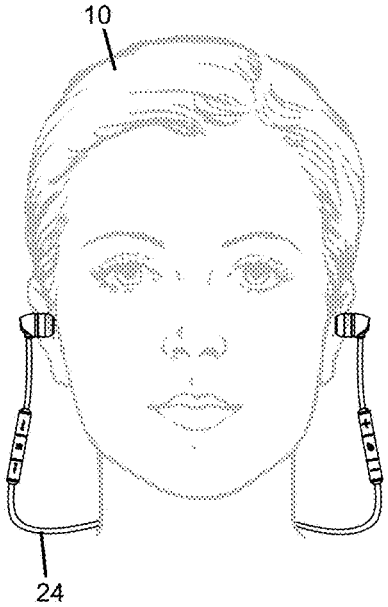
FIG. 1C shows the necklace of FIG. 1A in an open state worn as headphones.

FIG. 1C shows the necklace of FIG. 1A in an open state, worn as headphones. In this variation, the ear buds are disconnected from each other, such as those shown at the front of FIG. 1A, and the necklace has been "converted" into earphones 24. One can now wear the device as earphones, with one earphone in each ear, instead of as a necklace. The device can be turned over 180 degrees as well, such that what was on the bottom (relative to the orientation of the wearer and/or the ground) is now on the top. As such, the markings on the buttons or buttons themselves were not visible in FIG. 1A, but are so in FIG. 1C.

Figure 2A:
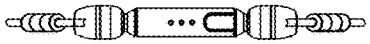
FIG. 2A shows a top plan view of a necklace in an open configuration, in embodiments of the disclosed technology.
Figure 2B:
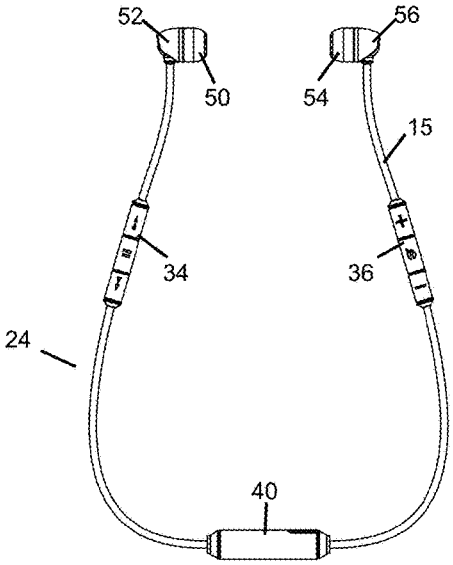
FIG. 2B shows a front side elevation view of the necklace of FIG. 2A.

FIG. 2A shows a top plan view of a necklace in an open configuration, in embodiments of the disclosed technology. FIG. 2B shows a front side elevation view of the necklace of FIG. 2A. In this open configuration, the device functions as earphones, such as shown in FIG. 1C. There is a first earphone 52 and a second earphone 56, each with a first end 50 and 54, respectively. The other end, opposite the first end where the wire 15 connects, is a "second end," for purposes of this disclosure. These earphones 50 and 54 rotate or pivot around a ball joint, in embodiments of the disclosed technology, changing their angle relative to the wire 15.

Figure 6:
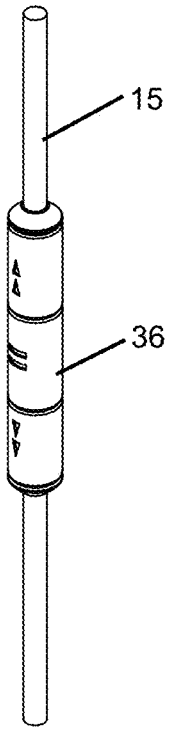
FIG. 6 shows another perspective view of the control housing and wire.

FIG. 6 shows another perspective view of the control housing and wire. Along the wire 15 are control housings 34 and 36. These control housings comprise buttons there-in to control at least one function of the earphones. These functions can be any of volume, power on/off, pause, play, fast forward, and/or rewind, by way of example only. In one embodiment, the volume and power are on one control housing 36 and changes to the play speed and/or position are on the other control housing 34. Thus, a "control" is defined as a button or other input used to modify the output or power state of a speaker within the earphone device. A control housing is defined as a device on which control is present. In embodiments, the two control housings 34 and 36 are of equal (exterior) size, shape, orientation, and look. That is, their color schemes and positions of stripes, and so forth, can match, as well as match that of colors and stripes, and colors of the stripes, of the pendant 40 (which can house a battery) and the earphones themselves. Various stripes are shown in FIG. 2B, accordingly.

Figure 2C:
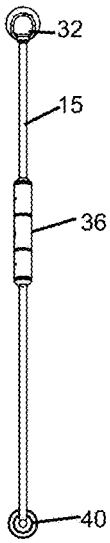
FIG. 2C shows a right side elevation view of the necklace of FIG. 2A.

FIG. 2C shows a right side elevation view of the necklace of FIG. 2A. The wire 15, it should be understood, can be a continuous wire from the pendant 40 to each earphone, or each separate segment can be its own wire between elements shown in FIG. 2B. There can also be multiple separate strands within the wire 15. Each earphone is electronically connected to a control within control housing 34 and 36.

Figure 2D:
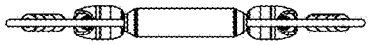
FIG. 2D shows a bottom plan view of the necklace of FIG. 2A.

FIG. 2D shows a bottom plan view of the necklace of FIG. 2A. Here, the pendant 40 is prominent. This pendant can comprise a battery there-within, or the battery can be in one of the control housings 34 or 36. The battery powers the device. Further, the pendant 40 can comprise a wireless transceiver receiving data wirelessly for play on the speakers within the earphones 50 and/or 54. This can be accomplished using "Bluetooth" or other wireless transmission protocols. Alternatively, a wire can attach to the pendant 40 to plug the earphones into a sound output jack of another device.

Figure 2E:
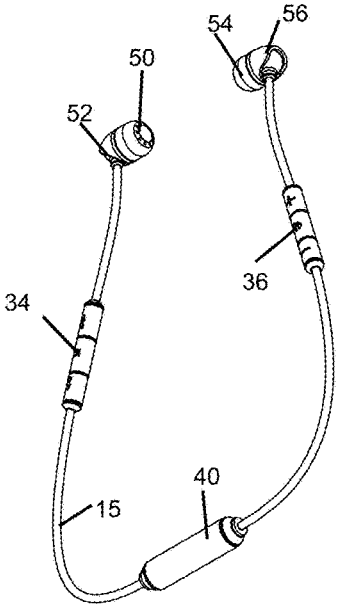
FIG. 2E shows a bottom and side perspective view of the necklace of FIG. 2A.

FIG. 2E shows a bottom and side perspective view of the necklace of FIG. 2A. Note that the buttons on the controls 34 and 36 face forward. When converting the earphones in this open loop configuration into a necklace, it may be desired to turn over the entire necklace, so that the buttons are against the wearer and less visible to an outside viewer. However, when the device is used as earphones, it may be desired to have the buttons face upward, away from the wearer, so that they can be accessed easily and can be seen to aid in access. The control housings and pendant, in embodiments of the disclosed technology, rotate with respect to the wire 15, allowing one to rotate the indicia or buttons from view.

Figure 3A:
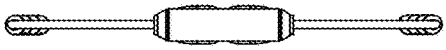
FIG. 3A shows a top plan view of a necklace in a closed configuration, in embodiments of the disclosed technology.
Figure 3B:
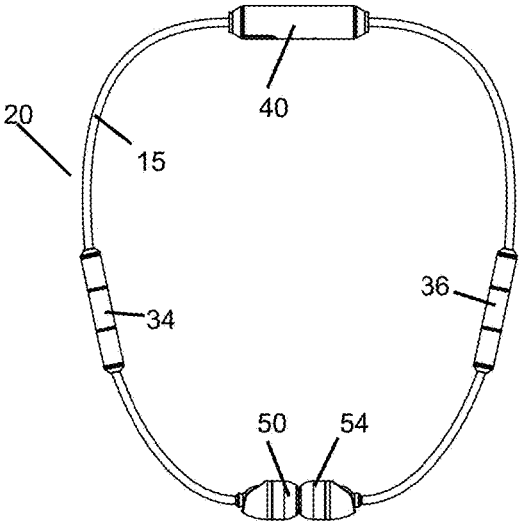
FIG. 3B shows a front side elevation view of the necklace of FIG. 3A.

FIG. 3A shows a top plan view of a necklace in a closed configuration, in embodiments of the disclosed technology. FIG. 3B shows a front side elevation view of the necklace of FIG. 3A. Here, the earphones 50 and 54 are coupled, or held together, by way of magnetic force emanating from a magnet situated within each earphone (separate and apart from another magnet in each earphone which, in embodiments of the disclosed technology, is used as part of a speaker to output sound).

Figure 3C:
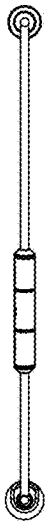
FIG. 3C shows a right side elevation view of the necklace of FIG. 3A.
Figure 3D:
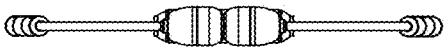
FIG. 3D shows a bottom plan view of the necklace of FIG. 3A.

FIG. 3C shows a right side elevation view of the necklace of FIG. 3A. FIG. 3D shows a bottom plan view of the necklace of FIG. 3A. Note that the ear buds abut one another, forming a Joined device which is similar in size to the pendant. This creates a closed loop configuration with symmetry. The pendant 40 can be made heavier than the ear buds 50 and 54 combined, and/or heavier than the combination of: ear buds 50/54 and controls 34/36. In this manner, the pendant 40, which also houses a battery, in embodiments of the disclosed technology, in a necklace configuration, as shown, will stay in front of a wearer, due to its greater weight. The control housings 34 and 36 then have the appearance of beads, such as three beads together, as shown, on each side of the necklace.

Figure 3E:
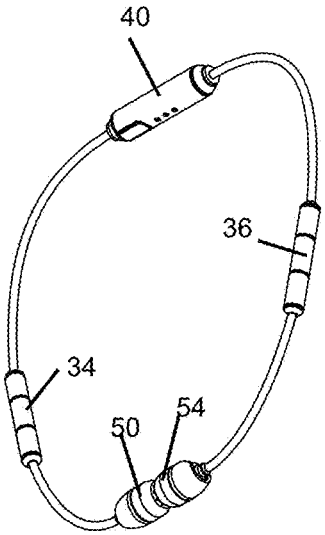
FIG. 3E shows bottom and side perspective views of the necklace of FIG. 3A.

FIG. 3E shows a bottom and side perspective view of the necklace of FIG. 3A. Further controls or inputs are shown in the pendant in this image.

Figure 4A:
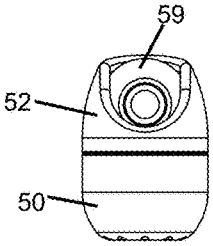
FIG. 4A shows a bottom plan view of an earphone and wire used in embodiments of the disclosed technology.

FIG. 4A shows a bottom plan view of an earphone and wire used in embodiments of the disclosed technology. Here, a ball pivot joint 59 is connected to a wire and is rotatable within a housing of the second end 52 of an ear bud. The ear bud 50 (having a first end where the label 50 is placed) has a speaker and magnet (extrinsic to the function of speaker which has its own magnet) therein.

Figure 4D:
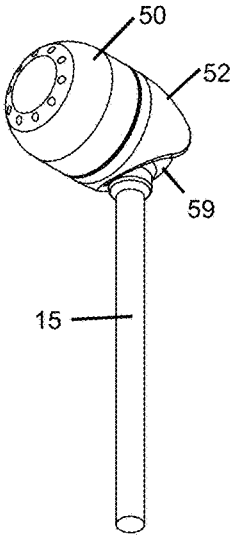
FIG. 4D shows bottom and side perspective views of the earphone and wire of FIG. 4A.
Figure 4B:
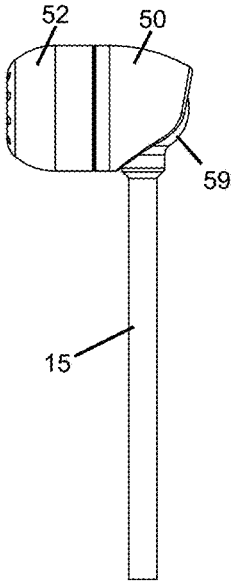
FIG. 4B shows a side elevation view of the earphone and wire of FIG. 4A.

FIG. 4B shows a side elevation view of the earphone and wire of FIG. 4A. Note that the ball joint pivot 59 is at a right angle to the earphone 52/50, as shown. This angle can change up to 90 degrees in embodiments of the disclosed technology, such that the wire 15 is in parallel or in-line with the longest length of the ear bud. In fact, referring back to the earlier figures, it is generally in parallel when in either the necklace form (closed loop) or worn as earphones. However, in the necklace form, the angle between the ear bud 50 and wire 15 (as well as the rest of the parts connected to the wire 15) is more acute because of the "tighter" or smaller loop. In the earphone set form (open loop), the added space means a change in angle. Either way, the earphones are in parallel with the pendant 40 on the opposite side, as this feature remains constant between the earphone set and necklace configuration.

Figure 4C:
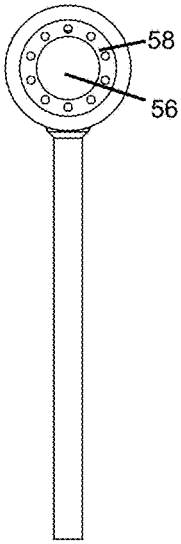
FIG. 4C shows a front elevation view of the earphone and wire of FIG. 4A.

FIG. 4C shows a front elevation view of the earphone and wire of FIG. 4A. The inner circular area 56 has a magnet directly there-beneath in embodiments, such that magnetic force emanates there-from. It should be understood that the opposite polarity faces towards the first end of each ear bud, such that each ear bud is attracted to the other. The disc 58 surrounding the circular region 56 allows for sound from a speaker to escape there-from and can include one or a plurality of portals. The positions of the disc 58 and magnetic area 56 can be reversed, such as by using a ring magnet in space 56 and a speaker in space 58.

Figure 4E:
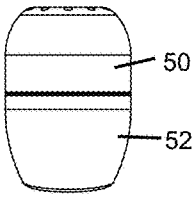
FIG. 4E shows a top plan view of the earphone and wire of FIG. 4A.

FIG. 4D shows a bottom and side perspective view of the earphone and wire of FIG. 4A. FIG. 4E shows a top plan view of the earphone and wire of FIG. 4A. The ear buds are shown in this figure from different angles, in order to get a better sense of the "barrel" shape defined as having a flat first and second end with curvilinear sides which are flat in the middle and tapered at each end.

Figure 5A:
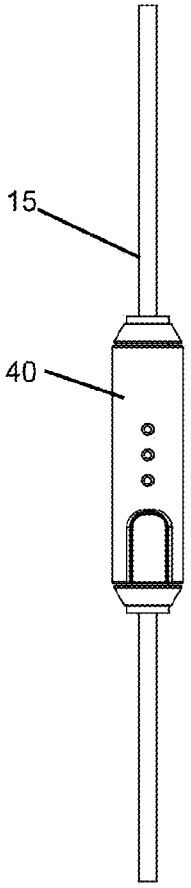
FIG. 5A shows a control housing and wire used in embodiments of the disclosed technology.
Figure 5B:
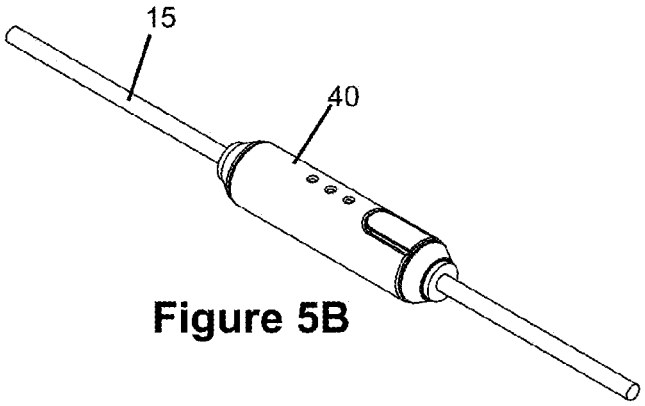
FIG. 5B shows a perspective view of the control housing and wire of FIG. 5A.

FIG. 5A shows a pendant and wire used in embodiments of the disclosed technology. FIG. 5B shows a perspective view of the pendant and wire of FIG. 5A. The pendant can comprise a battery, wireless transceiver, and ports to connect a Jack thereto via another wire, and be heavier than the other devices used in the necklace, in order that it may fall or remain in the front of the wearer. For purposes of this disclosure, directional vectors and orientations given are from the perspective of a wearer or donner (person carrying out a step of donning the necklace) of the necklace/earphone device who is standing on flat ground. This is for purposes of having a coherent terminology only, and is not limiting.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A combination necklace and earphones, comprising:

first and second earphones, each having a first end with a ball joint pivot and a second end with a magnetic field passing there-through, such that said second ends of each said first and said second earphones are in a magnetically held together condition when brought near each other, said second ends adapted to be received within the ears of a user;

a first length of wire electrically connecting said first earphone to a set of controls within a control housing;

a second length of wire electrically connected to said second earphone;

wherein said first length of wire including said control housing is of identical length as said second length of wire such that:

said first earphone is symmetric in size and position with said second earphone; and said first wire together with said control housing is symmetric in size and position with said second wire; and a pendant situated equidistant between said first and said second earphones, said pendant adapted to rest on a front portion of a neck of a user when said earphones are disposed in ears of said user.

2. The combination necklace and earphones of claim 1, wherein said first and second earphones have a color scheme including stripes, and wherein said pendant has an identical color scheme with identical stripes as each of said first and second earphone.

3. The combination necklace and earphones of claim 2, wherein said first and said second earphone in said magnetically held together condition are situated opposite said pendant in a closed loop.

4. The combination necklace and earphones of claim 3, wherein said first earphone and said second earphone rotate with respect to said pendant via said ball joint pivot, such that in said magnetically held together condition said first and second earphones form an elongate body, disposed in parallel with an elongate side of said pendant.

5. The combination necklace and earphones of claim 4, wherein, when said earphones are worn, said first wire is substantially perpendicular to said second end of said first earphone, and wherein when said first and said second earphones are in said magnetically held together condition said second ends of said first and second earphones are disposed along a longitudinal axis of said first and said second wires.

6. The combination necklace and earphones of claim 1, wherein each said second end of said first and said second earphones comprises an outer region with portals opening to a speaker, and an inner region covering a magnet used to create said magnetically held together condition.

7. A method of wearing a combination necklace and earphone device comprising the steps of:

donning a first and second earphone, each including a first end and a second end adapted to be received in the ears of a user, such that a control housing hangs downward from said first earphone via a first length of wire, and a second length of wire hangs downward from said second earphone, said first length of wire together with said control housing having the same height as said second length of wire and being equidistant from the ground, and such that a pendant attached to said first and second earphones is disposed on a front side of the neck of a user;

connecting said second ends of said first and said second earphone to each other via magnetic force, thereby forming a loop comprising said first and second earphones, a battery housing, said control housing, and said pendant, such that connected said first and said second earphones are at opposites of said loop from said pendant.

8. The method of claim 7, wherein, after said step of connecting, first and said second earphones are worn as part of a necklace.

9. The method of claim 8, comprising an additional step of disconnecting said second ends of said first and said second earphones from each other and then carrying out said step of donning.

10. The method of claim 7, wherein each said first end includes a ball joint pivot connecting said first earphone and said second earphone each to one of said first and said second lengths of wire.

11. The method of claim 7, wherein said first and second earphones have a color scheme with stripes, and wherein said pendant has an identical color scheme, with identical stripes, as each of said first and second earphones.

12. The method of claim 10, further comprising rotating said first earphone and said second earphone with respect to said pendant via said ball joint pivot, such that in said magnetically held together condition said first and second earphones form an elongate body disposed parallel with said pendant.

13. The method of claim 7, wherein an angle between said control housing and said second end of said first earphone is more acute after said step of donning than after said step of connecting.

14. The method of claim 7, wherein each said second end of said first and said second earphone comprises an outer region with portals opening to a speaker, and an inner region covering a magnet used to create said magnetically held together condition.

15. The method of claim 7, wherein each of said first and said second earphones is barrel shaped.

16. A combination necklace and earphones of claim 1, wherein each said first and second earphones is barrel shaped.

17. The combination necklace and earphones of claim 1, wherein said first and second earphones have a color scheme including stripes, and wherein said pendant has a reversed color scheme with identical stripes to that of a majority color of each of said first and second earphone.

18. The combination necklace and earphones of claim 4, wherein each first end of said first and second earphones includes a cavity housing said ball point pivot, and wherein, when said first earphone and said second earphone rotate with respect to said pendant, an edge of each of said first length of wire and said second length of wire is received in a corresponding said cavity.

* * * * *